US009144288B2

(12) United States Patent
Zhang

(10) Patent No.: US 9,144,288 B2
(45) Date of Patent: Sep. 29, 2015

(54) COSMETIC FLUID DISPENSER WITH CONTAINER CONTROLLED WAND POSITIONING

(75) Inventor: Derik Zhang, Liaobu Town Dongguan (CN)

(73) Assignee: Lava Industries, Inc., Monterey Park, CA (US)

( * ) Notice: Subject to any disclaimer, the term of this patent is extended or adjusted under 35 U.S.C. 154(b) by 743 days.

(21) Appl. No.: 13/507,621

(22) Filed: Jul. 16, 2012

(65) Prior Publication Data

US 2014/0348565 A1 Nov. 27, 2014

(51) Int. Cl.
*A46B 11/00* (2006.01)
*A45D 40/26* (2006.01)

(52) U.S. Cl.
CPC ..... *A45D 40/267* (2013.01)

(58) Field of Classification Search
CPC ..... A47D 34/045; A47D 34/043
USPC ..... 401/126, 127, 129
See application file for complete search history.

(56) References Cited

U.S. PATENT DOCUMENTS

| | | | | |
|---|---|---|---|---|
| 4,984,920 | A * | 1/1991 | O'Neill | 401/127 |
| 5,096,319 | A | 3/1992 | Gueret | |
| 5,121,763 | A * | 6/1992 | Kingsford | 132/317 |
| 6,142,692 | A | 11/2000 | Garcia | |
| 2006/0051154 | A1 | 3/2006 | Bauer et al. | |
| 2006/0051155 | A1 * | 3/2006 | Delage | 401/127 |
| 2007/0158372 | A1 | 7/2007 | Kurek et al. | |
| 2013/0129402 | A1 | 5/2013 | Johnson et al. | |

* cited by examiner

*Primary Examiner* — Huyen Le
(74) *Attorney, Agent, or Firm* — William W. Haefliger

(57) ABSTRACT

A cosmetic fluid dispenser, comprising in combination a generally tubular body, a generally tubular body extension forming a cosmetic fluid container, a longitudinally elongated wand received endwise into the container, the wand having a fluid applicator at one end of the wand to contact the fluid, and means responsive to manual relative rotation of the body and extension to progressively bodily displace the wand endwise to a removal position in which a portion of the wand projects from the body, for grasping and pull-out of the wand from the body, whereby the removed wand may be used to cosmetically dispense fluid from the applicator, following which the wand is returned to the body, and endwise retraction into the body and body extension.

7 Claims, 4 Drawing Sheets

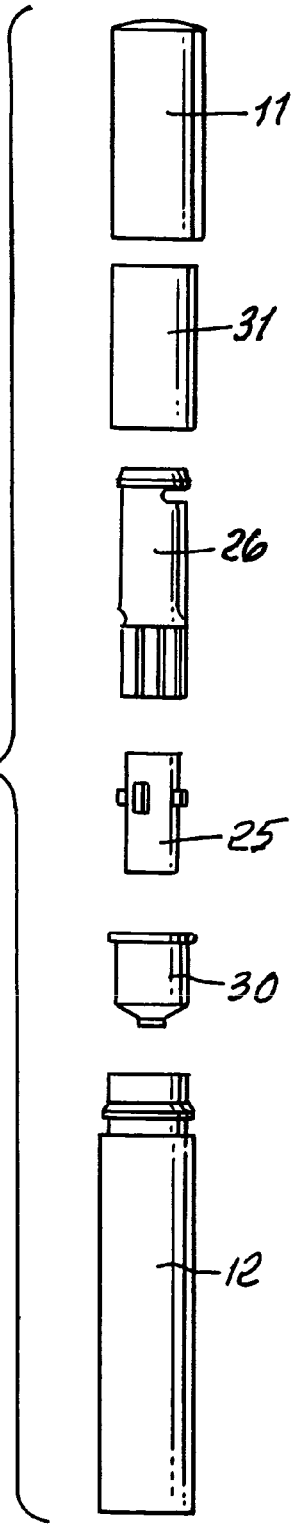
FIG. 6
FIG. 7
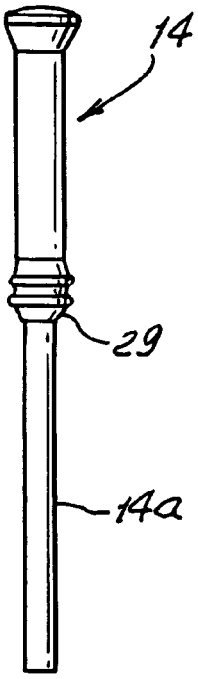
FIG. 8
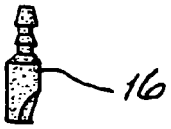

COSMETIC FLUID DISPENSER WITH CONTAINER CONTROLLED WAND POSITIONING

BACKGROUND OF THE INVENTION

This invention relates generally to dispensing of cosmetic fluid, and more particularly to controlled and metered dispensing of such fluid.

There is need for means to control and thereby conserve cosmetic fluid use and dispensing, via a wand and also to enable controlled metering dispensing by means of apparatus that is easily usable and storable in readily dispensing mode, for simple, reliable instant use of the dispensing wand.

SUMMARY OF THE INVENTION

It is a major object of the invention to provide an improved and preferred cosmetic fluid dispenser meeting the above need. Basically, the dispenser comprises:

a) a generally tubular body, b) a generally tubular body extension forming a cosmetic fluid container, c) a longitudinally elongated wand received endwise into the container, the wand having a fluid applicator at one end of the wand to contact the fluid, d) means responsive to manual relative rotation of the body and extension to progressively bodily displace the wand endwise to a removal position in which a portion of the wand projects from the body, for grasping and pull-out of the wand from the body, e) whereby the removed wand may be used to cosmetically dispense fluid from the applicator, following which the wand is returned to the body, and endwise retraction into the body and body extension.

Another object is to provide the actuation means in the form of a jacket extending about the wand to be movable therewith, and a driven element engaging the jacket to advance and retract the jacket and wand in response to said relative rotation. As will be seen, the jacket and driven element may have screw engagement to advance or retract the jacket, longitudinally, as the driven element is rotated by relative rotation of the body and its extension. In this regard, the jacket is preferably tubular to removably receive the wand in fitted engagement, for longitudinal wand advancement and retraction and for wand pull-out from the jacket.

A further object is to provide an external and annular flange on the wand to project about the wand axis, and a sealing sleeve extending about the wand to seat the flange as the wand is returned to retracted position.

As will be seen, that sleeve may be elastomeric with taper in a wand returning direction to efficiently and adjustably seal about and against the wand surface during such returning of the applicator into fluid in the body extension.

The applicator may comprise any of the following:

a) mascara applicator, b) sponge, c) eyeliner applicator d) skin engager.

Also, the body extension is preferably transparent for enabling visual status identification of the applicator, and re-fillable fluid in the container.

These and other objects and advantages of the invention, as well as the details of an illustrative embodiment, will be more fully understood from the following specification and drawings, in which:

DRAWING DESCRIPTION

Figure 4:
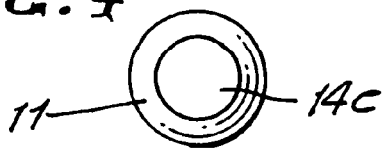
Figure 1:
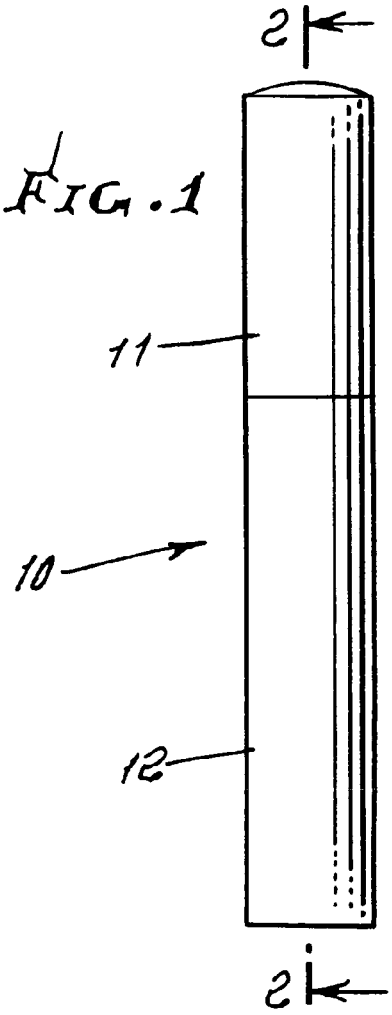
FIG. 1 is an external elevation showing one preferred form of the cosmetic fluid dispenser, in closed or stored condition.
Figure 3:
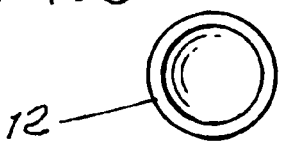
Figure 2:
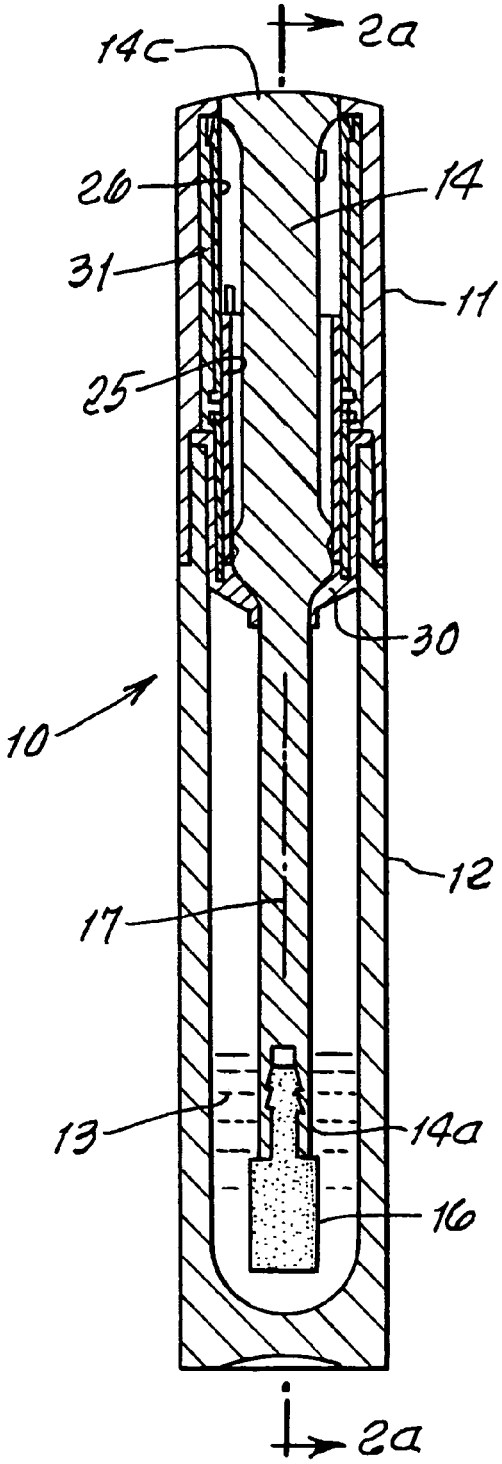
FIG. 2 is a section taken on lines 2-2 of FIG. 1.
Figure 2A:
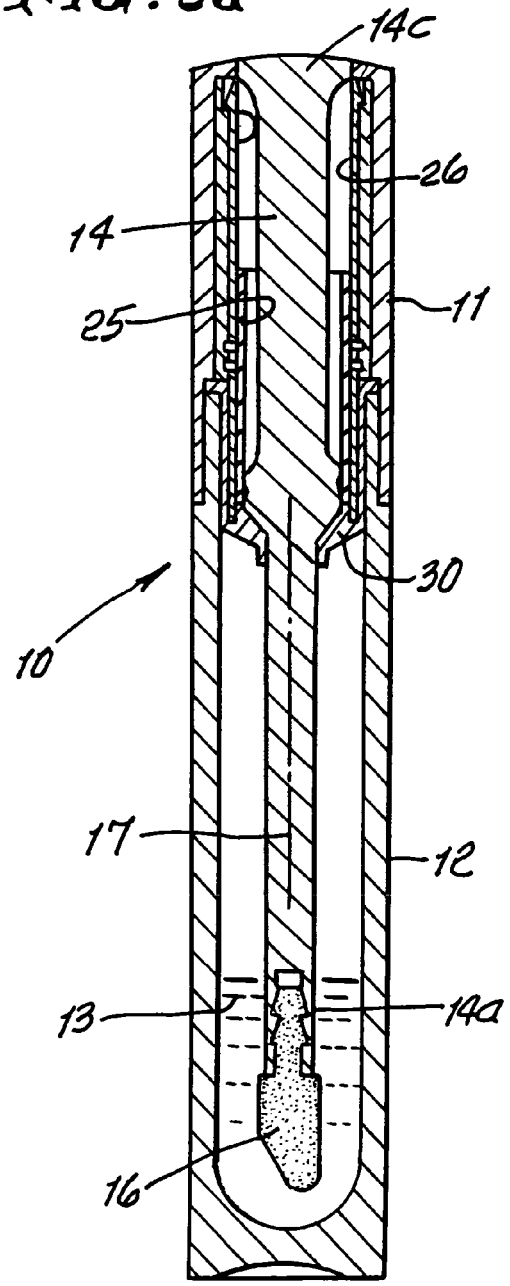
Figure 5:
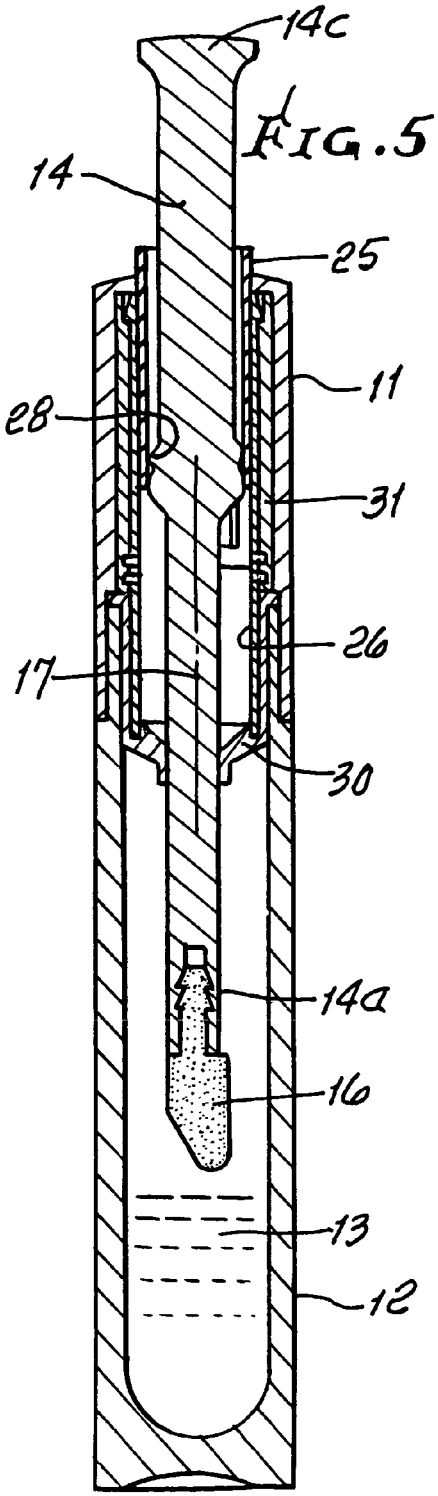
Figure 9:
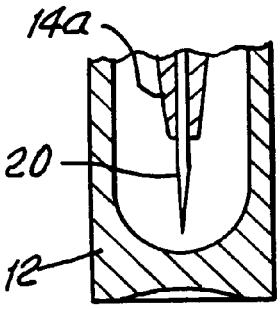
Figure 10:
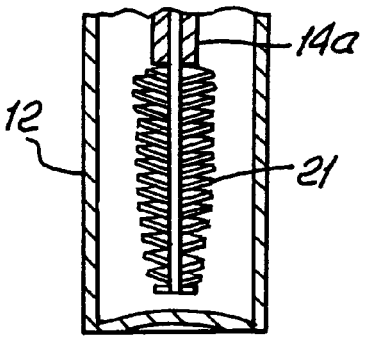
Figure 11:
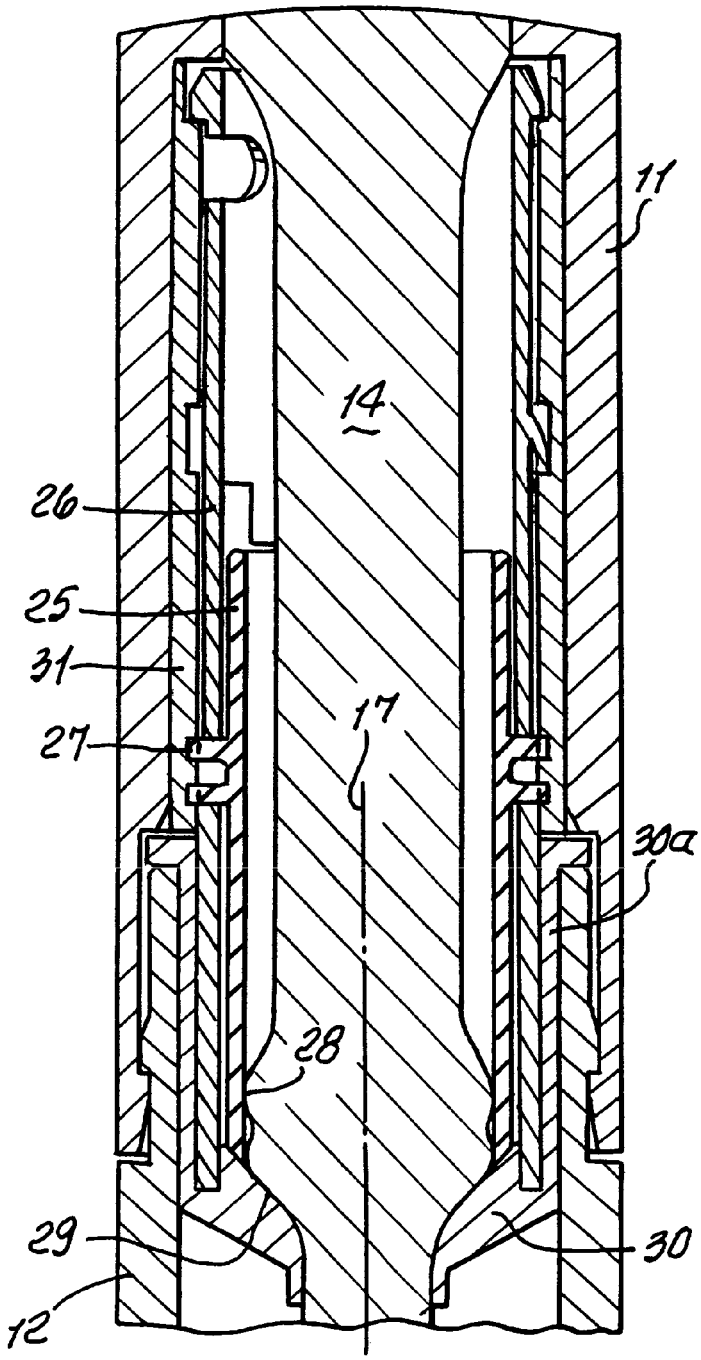

FIG. 2*a* is a section taken on lines 2*a*-2*a* of FIG. 2;

FIG. 3 is a bottom plan view of the FIG. 2 dispenser;

FIG. 4 is a top plan view of the FIG. 2 dispenser;

FIG. 5 is a view like FIG. 2, but showing the dispenser in wand extended position;

FIG. 6 is an exploded view showing elements of the dispenser;

FIG. 7 is a side elevational view of the dispensing wand of the device;

FIG. 8 is a side elevational view of a dispensing sponge carried by the FIG. 7 wand;

FIG. 9 is a view of a fluid dispensing eye liner used instead of a sponge;

FIG. 10 is a view of a mascara fluid dispenser used instead of a sponge; and FIG. 11 is an enlarged view of means to extend and retract the wand, in the device.

DETAILED DESCRIPTION

Referring first to the preferred dispenser 10 shown in FIGS. 1-5, it comprises a generally tubular body 11, from which a generally tubular body extension 12 projects, to define a container for cosmetic fluid. An elongated wand 14 is received endwise axially within the body and its extension to project into fluid 13. The wand carries a fluid applicator 16 at the wand end extent 14*a*, the applicator having the form of a small sponge.

In accordance with the invention, means or mechanism is provided to be responsive to relative rotation of body 11 and extension 12, about axis 17, to progressively and bodily displace the wand endwise of the body to a wand pull-out position seen in FIG. 5. In that position, the opposite, i.e. upper, end 14*b* of the wand projects from the body 11. That upper end may incorporate a wand head 14*c* which is manually graspable. The wand is then easily removable by endwise pull-out from its FIG. 5 position, for use of the applicator to apply fluid or liquid via the applicator sponge to skin, for cosmetic purposes, such as lip gloss. After such use, the wand can be easily re-inserted into the body 11, by reverse relative rotation, of 11 and 12 for retraction into FIG. 2 position, with the applicator in contact with fluid 13.

FIG. 9 shows the applicator in the form of an eye-liner 20; and FIG. 10 shows the applicator in the form of a mascara brush 21, for eyelash application. Also, the body extension 12 may typically be transparent, to enable visual determination of the positioning of the applicator in contact with fluid or liquid in the container defined by extension 12, the level of the re-fillable fluid or liquid being changed in accordance with its use.

The means referred to above includes a jacket 25 extending about the wand to be movable endwise with the wand in the body 11; and a driven element 26 peripherally engages the jacket to advance and retract it endwise in response to clockwise and counterclockwise relative rotation of the body 11 and its extension 12. Such engagement may be a screw thread engagement at 27, of tubular driven element 26 with the jacket 25. The jacket may consist of elastomeric material, to lightly grip and seal against the wand, while enabling withdrawal of the wand endwise from the jacket, as well as endwise re-insertion of the wand into and through the jacket. See FIG. 5, also, the elastomeric material, being deformable, allows light screw thread engagement at its periphery, sufficient to lightly and locally resiliently deform the jacket for displacing it endwise in response to the relative rotation of the body and its extension, as referred to. Also, the jacket fittingly and slidably engages the wand endwise, as at 28 and at the same time enabling easy endwise removal of the wand from the jacket in FIG. 5 and subsequent re-insertion of the wand into the jacket, which moves with the wand between FIG. 2 and FIG. 5 positions.

The wand typically has an annular seating and sealing wand flange 29 projecting about the wand axis, and there is a sealing sleeve 30 extending about the wand to seat the flange as the wand is returned to retracted position. Sleeve 30 tapers in a wand returning direction in said extension to seal against the wand surface during such returning.

The driven element 26 (driven by 11 and 31) engages the jacket 27 to advance and retract the jacket and wand in response to said relative rotation. The jacket and element 31 have screw threaded engagement. As shown, the jacket is tubular to removably receive the wand in fitted engagement, for longitudinal wand advancement and retraction and for wand pull-out from the jacket. Sealing sleeve 30 extend upwardly at 30*a* to seal against the bore of 12.

What is claimed is:

1. A cosmetic fluid dispenser, comprising in combination:

a) a generally tubular body, b) a generally tubular body extension forming a cosmetic fluid container, c) a longitudinally elongated wand received endwise into the container, the wand having a fluid applicator at one end of the wand to contact the fluid, d) means responsive to manual relative rotation of the body and extension to progressively bodily displace the wand endwise to a removal position in which a portion of the wand projects from the body, for grasping the wand, having a use position in which it is removed by pull out from the body, said means including a jacket extending about the wand to be movable therewith, and a driven element engaging the jacket to advance and retract the jacket and wand in response to said relative rotation, e) whereby the removed wand may be used to cosmetically dispense fluid from the applicator, following which the wand is returned to the body, and endwise retraction into the body and body extension.

2. The combination of claim 1 wherein the applicator comprises one of the following:

a) mascara applicator, b) sponge, c) eyeliner applicator, d) skin engager.

3. The combination of claim 2 wherein the body extension is transparent and enables visual status identification of the applicator, and re-fillable fluid in the container.

4. The combination of claim 1 wherein the wand has an annular flange projecting about the wand axis, and there being a sealing sleeve extending about the wand to seat the flange as the wand is returned to retracted position.

5. The combination of claim 4 wherein the sealing sleeve tapers in a wand returning direction in said extension to seal and seat against the wand surface during such returning.

6. The combination of claim 1 wherein said jacket and element have screw engagement.

7. The combination of claim 1 wherein the jacket is tubular to removably receive the wand in fitted engagement, for longitudinal wand advancement and retraction and for wand pull-out from the jacket.

* * * * *